US011103769B2

(12) United States Patent
Andreae et al.

(10) Patent No.: US 11,103,769 B2
(45) Date of Patent: Aug. 31, 2021

(54) HIDE, SEEK, AND COUNTDOWN GAME DEVICE AND METHOD

(71) Applicant: Pressure Games, Inc., Punta Gorda, FL (US)

(72) Inventors: Alexander James Andreae, Punta Gorda, FL (US); Sebastian Luke Andreae, Punta Gorda, FL (US)

(73) Assignee: PRESSURE GAMES, INC., Punta Gorda, FL (US)

( * ) Notice: Subject to any disclaimer, the term of this patent is extended or adjusted under 35 U.S.C. 154(b) by 29 days.

(21) Appl. No.: 16/777,954

(22) Filed: Jan. 31, 2020

(65) Prior Publication Data

US 2020/0246687 A1 Aug. 6, 2020

Related U.S. Application Data

(60) Provisional application No. 62/799,904, filed on Feb. 1, 2019.

(51) Int. Cl.

| | |
|---|---|
| ***A63F 9/24*** | (2006.01) |
| ***A63F 9/00*** | (2006.01) |
| ***G07C 1/28*** | (2006.01) |

(52) U.S. Cl.

CPC ..... *A63F 9/24* (2013.01); *A63F 9/0096* (2013.01); *G07C 1/28* (2013.01); *A63F 2009/2402* (2013.01); *A63F 2009/2447* (2013.01); *A63F 2009/2452* (2013.01); *A63F 2009/2457* (2013.01)

(58) Field of Classification Search

None

See application file for complete search history.

(56) References Cited

U.S. PATENT DOCUMENTS

| | | | |
|---|---|---|---|
| 4,169,592 | A | 10/1979 | Hall |
| 4,207,087 | A | 6/1980 | Baer et al. |
| 4,240,638 | A | 12/1980 | Baer et al. |
| 4,320,901 | A | 3/1982 | Morrison et al. |
| 4,496,149 | A | 1/1985 | Schwartzberg |
| 4,961,575 | A | 10/1990 | Perry |

(Continued)

FOREIGN PATENT DOCUMENTS

| | | | |
|---|---|---|---|
| GB | 2070943 | A | 9/1981 |
| WO | 20045921 | A1 | 8/2000 |

*Primary Examiner* — Ronald Laneau

(74) *Attorney, Agent, or Firm* — MH2 Technology Law Group LLP

(57) ABSTRACT

An apparatus and method for a hide-and-seek game, of which the apparatus includes a housing, a gameplay status indicator coupled to the housing, interface elements coupled to the housing and configured to receive input from a user or provide output to the user, and a processor configured to execute operations. The operations include initiating a timer in response to a first player selecting to play a hide-and-seek game and entering a first input using the interface elements, the first input indicating that the apparatus is hidden, receiving a second input from a second player prior to the completion of the timer, the second input indicating that the second player has located the apparatus that was hidden, and executing a predetermined number of challenges, in response to receiving the second input from the second player, using the gameplay status indicator and the interface elements.

20 Claims, 5 Drawing Sheets

(56) References Cited

U.S. PATENT DOCUMENTS

| | | | | |
|---|---|---|---|---|
| 5,520,387 | A | 5/1996 | Snow | |
| 6,311,982 | B1 | 11/2001 | Lebensfeld et al. | |
| 6,494,457 | B2 * | 12/2002 | Conte | A63F 9/24 273/460 |
| 6,530,841 | B2 | 3/2003 | Bull et al. | |
| 7,413,192 | B1 | 8/2008 | Van Buren | |
| 9,186,573 | B2 | 11/2015 | Perkins | |
| 2008/0070656 | A1 | 3/2008 | Somuah | |
| 2012/0052944 | A1 | 3/2012 | Saddler et al. | |
| 2012/0235357 | A1 | 9/2012 | Chambers | |
| 2014/0087797 | A1 * | 3/2014 | Siddharth | A63F 13/80 463/9 |
| 2019/0015747 | A1 * | 1/2019 | Thompson | H04N 13/351 |

* cited by examiner

HIDE, SEEK, AND COUNTDOWN GAME DEVICE AND METHOD

CROSS REFERENCE TO RELATED APPLICATIONS

This application claims priority to U.S. Provisional Patent Application having Ser. No. 62/799,904, which was filed on Feb. 1, 2019 and is incorporated by reference herein in its entirety.

BACKGROUND

Various handheld gaming devices are used for entertainment. Generally, handheld gaming devices are portable, but the location of the user and/or the device may not be a part of the game. For example, many handheld electronic games are essentially computer games that are played on a portable console. Other handheld games include lights and buttons, in which a user is prompted to copy a sequence of buttons, which may be of increasing speed, complexity, etc.

Some handheld gaming devices do utilize the location or movement of the user as part of the gameplay experience, however. For example, some handheld games may employ a camera of the device to include the physical area around the user in the gameplay (sometimes referred to as "augmented reality"). Other handheld games may allow a user to seek a hidden device in response to an audible tone, GPS location, or may guide users with hints based on responses to questions (e.g., as an academic study aid).

SUMMARY

Embodiments of the disclosure may provide a method for operating a hide-and-seek device, including initiating a timer in the device in response to a first player selecting to play a hide-and-seek game using the device and entering a first input indicating that the device is hidden, receiving a second input from a second player prior to the completion of the timer, the second input indicating that the second player has located the device that was hidden, and executing a predetermined number of challenges, in response to receiving the second input from the second player, using a gameplay status indicator of the device and one or more interface elements of the device until either the timer expires or the second player completes the predetermined number of challenges.

Embodiments of the disclosure may also provide an apparatus for a hide-and-seek game, including a housing, a gameplay status indicator coupled to the housing, one or more interface elements coupled to the housing and configured to receive input from a user, provide output to the user, or both, and a processor configured to execute operations. The operations include initiating a timer in response to a first player selecting to play a hide-and-seek game and entering a first input using the one or more interface elements, the first input indicating that the apparatus is hidden, receiving a second input from a second player prior to the completion of the timer, the second input indicating that the second player has located the apparatus that was hidden, and executing a predetermined number of challenges, in response to receiving the second input from the second player, using the gameplay status indicator and the one or more interface elements until either the timer expires or the second player completes the predetermined number of challenges.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
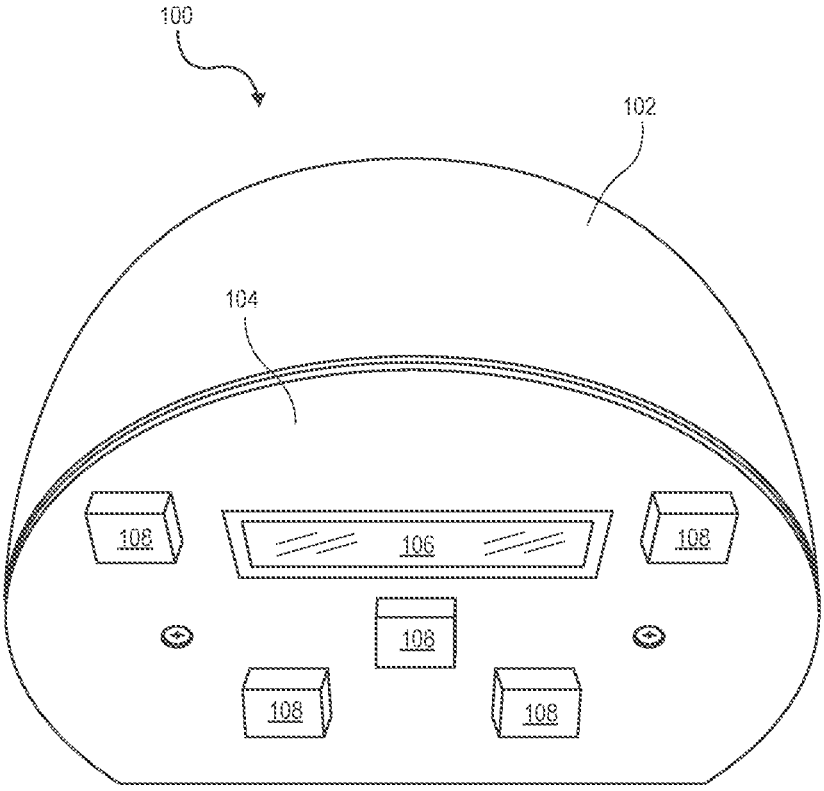
FIG. 1 illustrates a raised perspective view of a hide, seek, and countdown gaming device, according to an embodiment.

Embodiments of the disclosure may provide an electronic game device used to play a variation of "hide-and-seek." Rather than players hiding and a single player seeking the players, a first player may hide the device and one or more second player(s) may seek the hidden device. Upon one of the second players finding the device, the device may initiate one or more challenges, under time constraint, for the one or more of the second players to complete in order to win the game. In some embodiments, the device does not guide the player as to where to locate the device but may be programmed to facilitate the second players finding the device. The location of the device itself or the player(s) is generally not part of the game, as nothing hinges on the absolute geographic location of the device or its users, unlike, for example, GPS-enabled or augmented reality devices. In other words, the device may not suggest or require hiding locations, nor does it adjust game play based on such location.

In traditional hide-and-seek games, there is no way to modulate the difficulty or complexity of gameplay; rather, the object (or person) is either found or not. Embodiments of the present disclosure, however, may include the ability to modulate gameplay difficulty and/or complexity. For example, the device may implement a timer and interface elements for gameplay and may incorporate a screen to display current state. Before a game starts, the device may present multiple options to set the time limit for the game or some method to adjust the difficulty of the game. The first player ("Hider") then hides the device and initiates the timer. A short delay may be introduced to allow the Hider to return to or otherwise communicate to the second player ("Seeker") that the device is ready to be sought. After the delay, the timer begins counting down and an audible tone or sequence of tones, or a light or sequence of lights (or other visual indicators) may be played to assist the seeker in finding the device. Once found, one or more challenges involving the interface elements on the device must be completed to stop the timer and win; otherwise, the Hider wins.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a raised, perspective view of a hide, seek, and countdown gaming device 100, according to an embodiment. The gaming device 100 may generally include an outer housing 102, which may be generally hemispherical in shape, as shown, e.g., with a flattened bottom for resting on a surface such as a table. In other embodiments, the housing 102 may take on other shapes.

Figure 2:
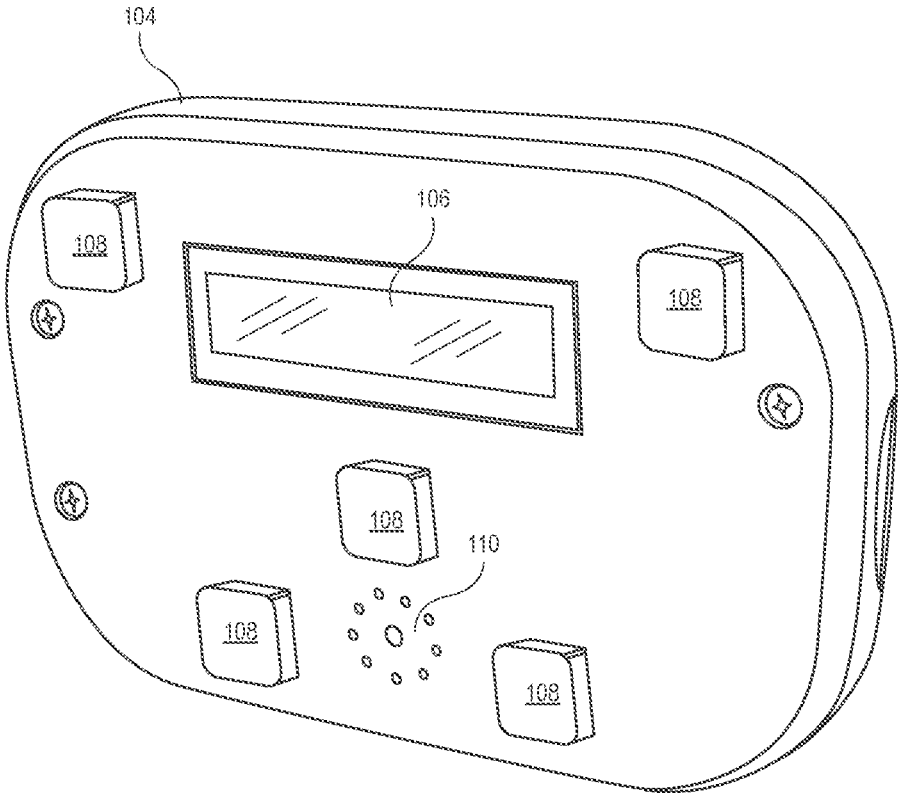
FIG. 2 illustrates a view of a faceplate of the gaming device, according to an embodiment.

The device 100 may also include a faceplate 104. FIG. 2 illustrates an enlarged view of the faceplate 104. The faceplate 104 may include a gameplay status indicator. In an embodiment, the gameplay status indicator may be, as illustrated, a display or screen 106. The gameplay status indicator may be configured to provide output data to a user related to gameplay, such as time remaining, challenges remaining, type of game being played, instructions, etc. The screen 106 may also be able to receive input (e.g., as an input/output device), and may be, for example, a touch screen. In other embodiments, the screen 106 may be configured only to display data. In either case, the screen 106 may be configured to display text, pictures, animation, etc., which may convey the gameplay status.

The faceplate 104 may also include one or more interface elements, e.g., buttons 108 positioned on or near the faceplate and screen 106. The buttons 108 may be configured to provide input to a processor (e.g., programmable logic controller, microprocessor, etc.) contained within the housing 102. The device 100 may also include a speaker 110 or other audio-output device (e.g., whistle, buzzer, etc.), which may be contained within the housing 102. In some embodiments, the device 100 may not include a visual screen display, but may employ audible cues (e.g., speech providing gameplay status) instead. In some embodiments, a display may be employed along with such audible cues. Furthermore, in at least one embodiment, the interface elements may include a motion detection feature, provided by motion sensors, accelerometers, etc., which may enable challenges (as will be described in greater detail below) to be played that include motion of the device 100 (e.g., jumping, duck, run, or otherwise move the device 100 in response to a visual or audible prompt). Such games may be referred to as "motion detection" games.

Returning to the example of the interface elements including buttons 108, in use, the buttons 108 may allow for selection of options displayed on the screen 106. The buttons 108 may allow a user to select a game, select a difficulty, manipulate other gameplay settings (e.g., number of users, countdown time, etc.), start or terminate a game, and enter input during gameplay. The buttons 108 may also light up, providing output, e.g., as part of the game play. For example, a sequence of different buttons 108 and/or different colors may light up, and the game may call for the user to follow the sequence, or press a specific colored button, etc., as part of the game. It will be appreciated that the input devices are not limited to buttons. Indeed, any type of input device, e.g., sliders, switches, etc. may be employed in lieu of or in addition to the illustrated buttons 108.

Figure 3:
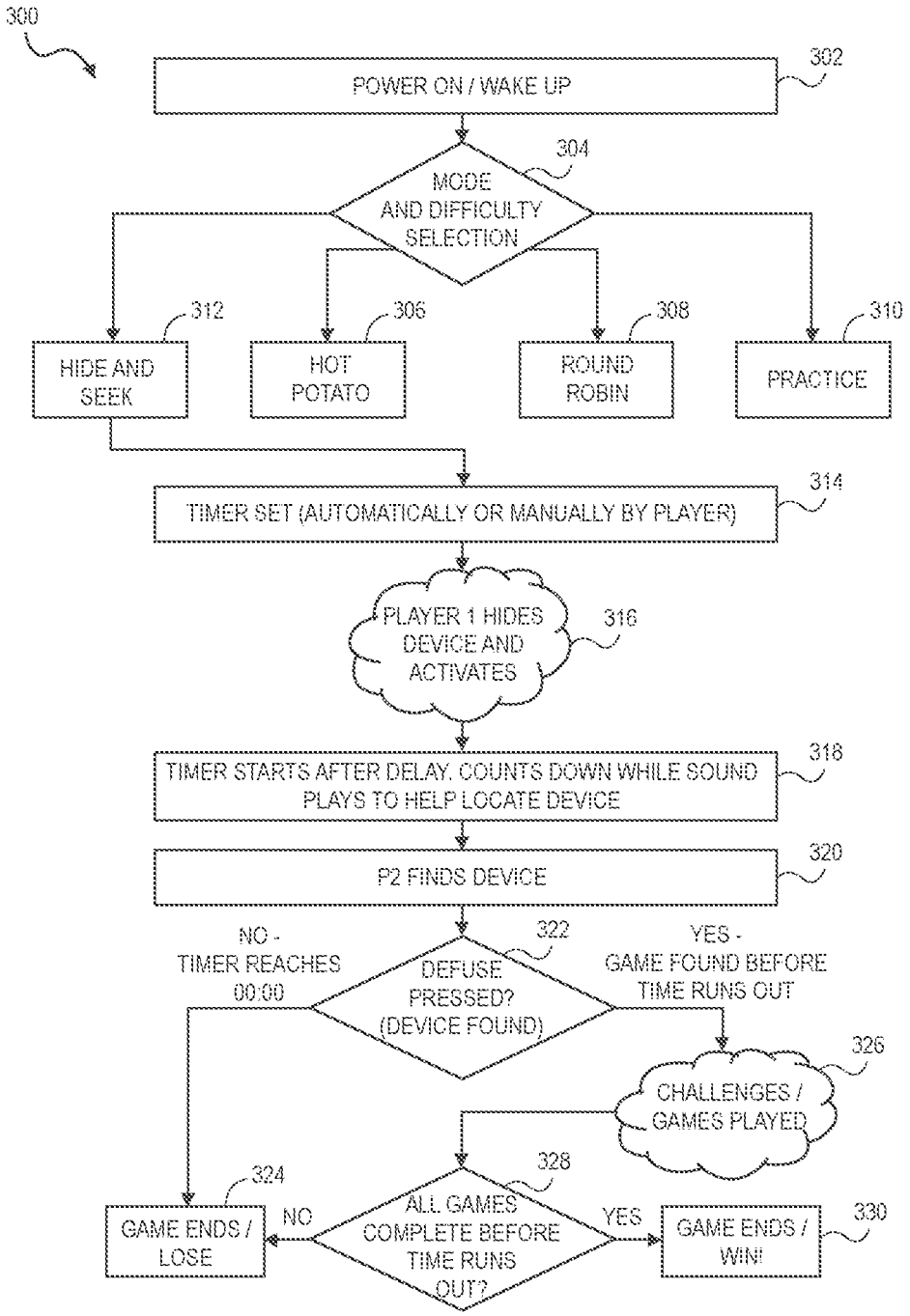
FIG. 3 illustrates a flowchart of a method for playing a hide, seek, and countdown game using the device, according to an embodiment.

FIG. 3 illustrates a flowchart of a method 300 for playing a game using the device 100, according to an embodiment. The method 300 may begin by powering on or otherwise waking up the device 100, as at 302. This may be accomplished using a power button or switch, which may or may not be one of the buttons 108. The method 300 may then include a user selecting a mode and difficulty, as at 304. The selection may be implemented using the buttons 108, or through any other type of interaction between the user and the device 100 (e.g., audio, movement, etc.).

Based on the selected mode or game at 304, the device 100 may move to a gameplay stage of the method 300. Some aspects of the gameplay stage may solely call for user interaction with the device 100, e.g., via the faceplate 104. Such gameplay stages may include hot potato 306, round robin 308, and practice mode 310, to name just a few among many possibilities. These stages may allow for a single player (or potentially multiple players) to enjoy gameplay, but without the hide/seek aspect, or otherwise for users to become familiar with the device 100 before playing other games.

Another aspect of the gameplay stage may include user interaction with the device, as well as with the environment and/or one or more other players. For example, the device 100 may be implemented in a hide-and-seek game, as at 312. The hide-and-seek game may call for a first player (hider) and one or more second players (seekers). In selecting the hide-and-seek game at 312, the first and/or second player may select difficulty level settings, which may determine timer duration(s), level of assistance finding the device 100 (e.g., by increasing or decreasing volume of an audible tone), the number or type of challenges to complete using the device 100, or the like. The difficulty may be set by entering a difficulty level within a range of values (e.g., 1-10 or easy/medium/hard) or by generalization, such as by entering the user's age. In the latter case, the ages, or other parameter employed as a substitute for difficulty level, may be associated with game settings that are implemented in response. The difficulty level (or generalization) may not be selected every time but may have a default or predetermined setting. The first and/or second player may also specify a number of players. Setting the difficulty level may specifically include determining a duration for a finding and completing the challenges, which specifies the length of time that the second player (seeker) has to find and complete the challenges using the device 100, as will be described in greater detail below.

After a first player selects to play the hide-and-seek game at 312, and after the settings are determined (which may occur before or after the first player selects to play the hide-and-seek game), the first player hides the device 100, as at 316. Either in response to an input from the first player or automatically at the expiration of a hiding timer, the timer may commence, as at 318. As noted in block 318, the timer may start after a delay (e.g., after expiration of another timer), which may provide a first player with time to move (e.g., return) to the location of the second player before the seeking timer begins.

During the duration of the timer, the second player attempts to find the device 100 that was hidden by the first player, as at 320. The duration of the timer may also be determined automatically, e.g., as a function of game difficulty level setting, or may be set by the first or second player individually each time a game commences. As also indicated at 318, an audible sound may be played, or the device 100 may flash a light, etc., which may assist the second player in locating the device 100. This may be configured based on the level of difficulty selected for gameplay.

The method 300 may include determining whether an input is received, as at 322, indicating that the second player has found the device 100 before the completion of the timer. If the second player does not find the device 100 before the timer expires, the game is over and the first player wins, as at 324.

If, on the other hand, the second player does find the device 100 before the timer expires, and the second player provides the input (e.g., button press) before the completion of the second timer, the method 300 may proceed to the device 100 executing one or more challenges, as at 326. Further, this may end the emission of the audible sound or flashing light, which may no longer be necessary. Alternatively, the audible sound or flashing light may continue, and may, in some embodiments, quicken in pace according to the amount of time left in the timer, e.g., to increase difficulty.

At this point, the device 100 may execute the one or more challenges at 326 using the screen 106, the buttons, or a combination thereof. The particular game or games initiated may depend on user selections at the beginning. For example, in one challenge, a sequence of different buttons 108 may light up, and the second player may have to repeat this sequence. Correctly following the sequence may add time to the timer, and after a certain number of correct sequences, the game may be completed, as at 328, and the second player wins, as at 330. Incorrect sequences, by contrast, may increase the speed at which the timer counts down, may subtract time, etc., and eventually lead to the second player losing at 324.

It will be appreciated that any number of challenges may be played, with varying levels of difficulty that may be set according to the second player's abilities. For example, other such games could include button sequencing/memory games, quick reflex games, motion detection games or physical challenges (e.g., jumping, running, and/or ducking) or other cognitive, reflex or related puzzles utilizing button 108 presses, light elements, sequences or sounds, or other interface elements of the device 100. In another specific example, a sequence of lights (e.g., different buttons 108) may be displayed to the second player (the seeker) before the first player (hider) hides the device 100. Upon locating the device 100, the second player may complete the challenge by entering the same sequence.

Further, it will be appreciated that three or more players may play at once, with two or more players being the seekers. One of the players finds the device 100 and completes a challenge (or a predetermined number of challenges), and then the screen 106 displays for the player to pass the device 100 to another player to complete another challenge within the remaining duration of the second timer. This may repeat until all of the players have completed a challenge, or until the second timer runs out, with the seeker who is caught with the device 100 when the time runs out being the loser.

Figure 4:
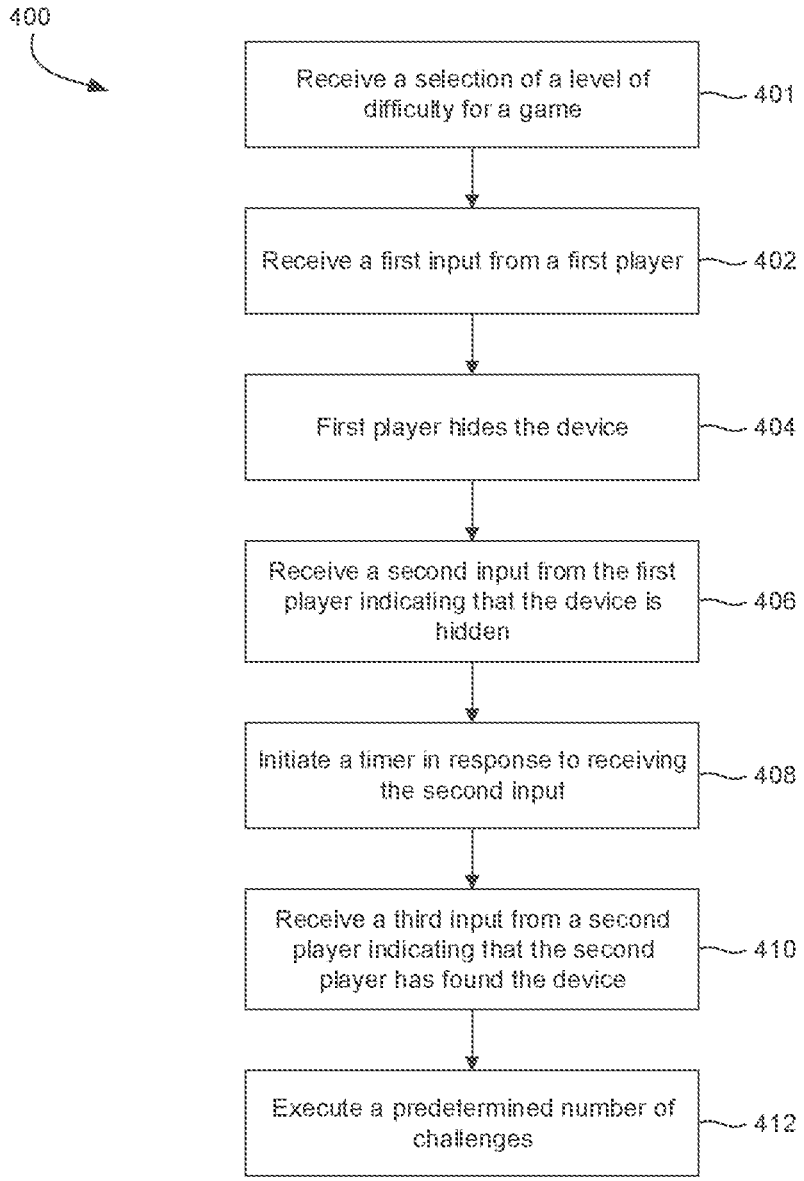
FIG. 4 illustrates a flowchart of another method for operating the device, according to an embodiment.

FIG. 4 illustrates a flowchart of a method 400 for operating a hide-and-seek game, according to an embodiment. The method 400 may be executed using an embodiment of the device 100 discussed above, but in other embodiments, may employ other structures in addition to or in lieu of the device 100. The method 400 may begin receiving a selection of a level of difficulty for a hide-and-seek game, as at 401. The number of challenges, a type of challenge of the challenges, or both may be selected based on the received selection of the level of difficulty.

The method 400 may then proceed to receiving a first input from a first player, as at 402. The first input may be received via one or more interface elements (e.g., buttons 108) of the device 100. The first input may indicate that the first player intends for the device 100 to be used for the hide-and-seek game, e.g., rather than a single-player game.

The first player may then hide the device 100, as at 404, e.g., position the device 100 in an inconspicuous location, and a second player may, at least initially, be unaware of this location. The device 100 may include a delay timer that allows the first player time to hide the device 100. In some embodiments, the device does not change state or provide information to the first player that assists the first player hiding the device. Rather, the first player is free to hide the device, and, in some embodiments, nothing about gameplay hinges upon the physical location of the device other than whether the second player(s) find the device. In some embodiments, the device 100 is configured to emit a noise, light, both, or neither, therefrom after initiating a timer and prior to receiving a second input from the second player, to assist the second player in locating the device 100, depending on the level of difficulty selected at 401.

The method 400 may then include receiving a second input from the first player, indicating that the device is hidden, as at 406. The method 400 may further include initiating a timer in the device 100 in response to the first input and the second input, as at 408.

The method 400 may include receiving a third input from the second player prior to the completion of the timer, as at 410. The third input indicates that the second player has located the device that was hidden.

The method 400 may then include executing a predetermined number of challenges, as at 412. The predetermined number of challenges may be executed in response to receiving the third input from the second player. Further, the challenges may be executed using a display (e.g., screen 106) and one or more interface elements 108 of the device until either the timer expires, or the second player completes the predetermined number of challenges. In some cases, the second player may not successfully complete one of the challenges. The device 100 may respond by adjusting the timer, e.g., to decrease the duration by speeding up the timer or otherwise reducing remaining time. Likewise, the device 100 may respond to a successful completion of one of the challenges by increasing the remaining duration of the timer.

Further, in some embodiments, executing the predetermined number of challenges includes displaying a sequence of lights via the one or more interface elements. For example, the interface elements may include buttons that light up, and executing the challenged may further include receiving an input of the same sequence of lights via button presses from the user or executing a reflex game, or other cognitive, reflex, or puzzles using the interface elements, light elements, sequences, or sounds.

In some embodiments, after executing one or more of the challenges (e.g., the predetermined number thereof), the method 400 may proceed to displaying a command to switch users to a third player (e.g., another of the second players who were seeking to find the hidden device 100). The method 400 may then include executing a second predetermined number of challenges using the display and the one or more interface elements 108 of the device 100 until either the timer expires or the third user completes the second predetermined number of challenges.

Figure 5:
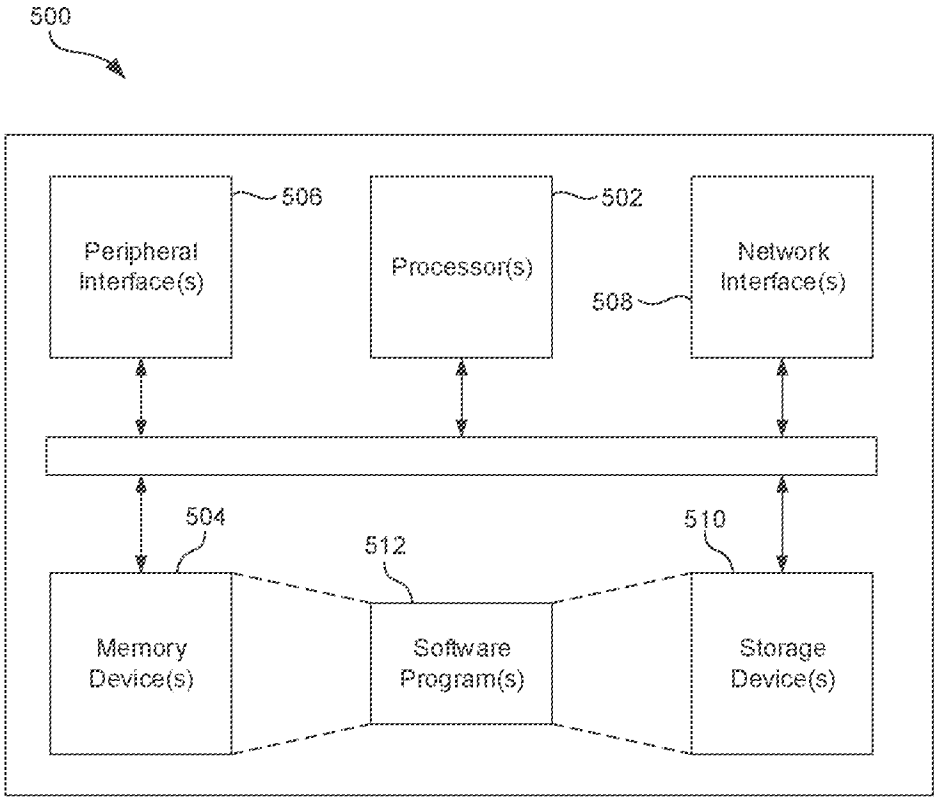
FIG. 5 illustrates a schematic view of a computing system, according to an embodiment.

Embodiments of the disclosure may also include one or more systems for implementing one or more embodiments of the methods of the present disclosure. FIG. 5 illustrates a schematic view of such a computing or processor system 500, according to an embodiment. The processor system 500 may include one or more processors 502 of varying core (including multiple-core) configurations and clock frequencies. The one or more processors 502 may be operable to execute instructions, apply logic, etc. It will be appreciated that these functions may be provided by multiple processors or multiple cores on a single chip operating in parallel and/or communicably linked together.

The processor system 500 may also include a memory system, which may be or include one or more memory devices and/or non-transitory computer-readable media 504 of varying physical dimensions, accessibility, storage capacities, etc. such as flash drives, hard drives, disks, random access memory, etc., for storing data, such as images, files, and program instructions for execution by the processor 502. In an embodiment, the computer-readable media 504 may store instructions that, when executed by the processor 502, are configured to cause the processor system 500 to perform operations. For example, execution of such instructions may cause the processor system 500 to implement one or more portions and/or embodiments of the methods 300, 400, and/or 500 described above.

The processor system 500 may also include one or more network interfaces 506. The network interfaces 506 may include any hardware, applications, and/or other software. Accordingly, the network interfaces 506 may include Ethernet adapters, wireless transceivers, PCI interfaces, and/or serial network components, for communicating over wired or wireless media using protocols, such as Ethernet, wireless Ethernet, etc.

The processor system 500 may further include one or more peripheral interfaces 508, for communication with a display screen, projector, keyboards, mice, touchpads, sensors, other types of input and/or output peripherals, and/or the like. In some implementations, the components of processor system 500 need not be enclosed within a single enclosure or even located in close proximity to one another, but in other implementations, the components and/or others may be provided in a single enclosure.

The memory device 504 may be physically or logically arranged or configured to store data on one or more storage devices 510. The storage device 510 may include one or more file systems or databases in any suitable format. The storage device 510 may also include one or more software programs 512, which may contain interpretable or executable instructions for performing one or more of the disclosed processes. When requested by the processor 502, one or more of the software programs 512, or a portion thereof, may be loaded from the storage devices 510 to the memory devices 504 for execution by the processor 502.

Those skilled in the art will appreciate that the above-described componentry is merely one example of a hardware configuration, as the processor system 500 may include any type of hardware components, including any necessary accompanying firmware or software, for performing the disclosed implementations. The processor system 500 may also be implemented in part or in whole by electronic circuit components or processors, such as application-specific integrated circuits (ASICs) or field-programmable gate arrays (FPGAs).

The foregoing description of the present disclosure, along with its associated embodiments and examples, has been presented for purposes of illustration only. It is not exhaustive and does not limit the present disclosure to the precise form disclosed. Those skilled in the art will appreciate from the foregoing description that modifications and variations are possible in light of the above teachings or may be acquired from practicing the disclosed embodiments.

For example, the same techniques described herein with reference to the processor system 500 may be used to execute programs according to instructions received from another program or from another processor system altogether. Similarly, commands may be received, executed, and their output returned entirely within the processing and/or memory of the processor system 500. Accordingly, neither a visual interface command terminal nor any terminal at all is strictly necessary for performing the described embodiments.

Likewise, the steps described need not be performed in the same sequence discussed or with the same degree of separation. Various steps may be omitted, repeated, combined, or divided, as necessary to achieve the same or similar objectives or enhancements. Accordingly, the present disclosure is not limited to the above-described embodiments, but instead is defined by the appended claims in light of their full scope of equivalents. Further, in the above description and in the below claims, unless specified otherwise, the term "execute" and its variants are to be interpreted as pertaining to any operation of program code or instructions on a device, whether compiled, interpreted, or run using other techniques.

What is claimed is:

1. A method for operating a hide-and-seek device, comprising:

initiating a timer in the device in response to a first player selecting to play a hide-and-seek game using the device and entering a first input indicating that the device is hidden;

receiving a second input from a second player prior to the completion of the timer, wherein the second input indicates that the second player has located the device that was hidden; and executing a predetermined number of challenges, in response to receiving the second input from the second player, using a gameplay status indicator of the device and one or more interface elements of the device until either the timer expires or the second player completes the predetermined number of challenges.

2. The method of claim 1, further comprising hiding the device, wherein the device does not change state, or provide information to the first player, to assist the first player hiding the device.

3. The method of claim 1, further comprising receiving a selection of a level of difficulty for the hide-and-seek game, wherein the predetermined number of challenges, a type of challenge of the predetermined number challenges, or both is or are selected based on the received selection of the level of difficulty.

4. The method of claim 3, wherein the device is configured to emit a noise, light, both, or neither, therefrom after initiating the timer and prior to receiving the input from the second player, depending on the selected level of difficulty.

5. The method of claim 1, wherein the device includes a faceplate, wherein the gameplay status indicator includes a screen, and wherein the one or more interface elements include buttons positioned on the faceplate.

6. The method of claim 1, wherein the second player failing one of the predetermined number of challenges decreases a duration of the timer.

7. The method of claim 1, wherein executing the predetermined number of challenges comprises:

displaying a sequence of lights via the one or more interface elements, wherein the one or more interface elements comprise buttons that light up, and receiving an input of the same sequence of lights via button presses from the second player; or executing a reflex game, or other cognitive, reflex, or related puzzles using the one or more interface elements, light elements, sequences, or sounds.

8. The method of claim 1, further comprising:

after executing the predetermined number of challenges, displaying a command to switch users to a third user; and executing a second predetermined number of challenges using the display and the one or more interface elements of the device until either the timer expires or the third user completes the second predetermined number of challenges.

9. The method of claim 1, further comprising delaying a start of the timer after receiving the input from the first player, to allow the first player to move to a location of the second player.

10. The method of claim 1, further comprising executing the predetermined number of challenges without first hiding the device.

11. An apparatus for a hide-and-seek game, comprising:

a housing;

a gameplay status indicator coupled to the housing;

one or more interface elements coupled to the housing and configured to receive input from a user, provide output to the user, or both; and a processor configured to execute operations, the operations comprising:

initiating a timer in response to a first player selecting to play a hide-and-seek game and entering a first input using the one or more interface elements, wherein the first input indicates that the apparatus is hidden;

receiving a second input from a second player prior to the completion of the timer, wherein the second input indicates that the second player has located the apparatus that was hidden; and executing a predetermined number of challenges, in response to receiving the second input from the second player, using the gameplay status indicator and the one or more interface elements until either the timer expires or the second player completes the predetermined number of challenges.

12. The apparatus of claim 11, wherein the processor is configured not to provide information to the first player that assists the first player with hiding the apparatus.

13. The apparatus of claim 11, wherein the operations further comprise receiving a selection of a level of difficulty for the hide-and-seek game, wherein the number of challenges, a type of challenge of the challenges, or both is or are selected based on the received election of the level of difficulty.

14. The apparatus of claim 13, further comprising a light, a speaker, or both, configured to emit a noise, light, or both, wherein, after the processor initiates the timer and prior to receiving the input from the second player, the processor is configured to cause the light, speaker, or both to emit the noise, light, or both, or to not emit the noise, light, or both, depending on the selected level of difficulty.

15. The apparatus of claim 11, further comprising a faceplate upon which a display is positioned, and buttons that provide at least some of the one or more interface elements.

16. The apparatus of claim 11, wherein the second player failing a challenge decreases a duration of the timer.

17. The apparatus of claim 11, wherein executing the predetermined number of challenges comprises at least one of:

displaying a sequence of lights via the one or more interface elements, wherein the one or more interface elements comprise buttons that light up, and receiving an input of the same sequence of lights via button presses from the user; or executing a reflex game, or other cognitive, reflex, or puzzles using the one or more interface elements, light elements, sequences, or sounds; or executing a motion detection game using a motion-detecting feature of the apparatus.

18. The apparatus of claim 11, wherein the operations further comprise:

after executing the predetermined number of challenges, displaying a command to switch users to a third user; and executing a second predetermined number of challenges using the display and the one or more interface elements until either the timer expires or the third user completes the second predetermined number of challenges.

19. The apparatus of claim 11, wherein the operations further comprise delaying a start of the timer after receiving the input from the first player, to allow the first player to move to a location of the second player.

20. The apparatus of claim 11, wherein the housing is generally hemispherical in shape.

* * * * *